United States Patent [19]

Massion

[11] Patent Number: 4,607,771

[45] Date of Patent: Aug. 26, 1986

[54] PRESENTATION DEVICE FOR TEXTILE PRODUCTS AND THE LIKE

[75] Inventor: Philippe A. J. Massion, Brussels, Belgium

[73] Assignee: S.P.R.L. LAMA P.V.B.A., Brussels, Belgium

[21] Appl. No.: 777,065

[22] Filed: Sep. 17, 1985

[30] Foreign Application Priority Data

Oct. 24, 1984 [BE] Belgium ..... 0/213.879

[51] Int. Cl.[4] ..... A41D 27/22

[52] U.S. Cl. ..... 223/91

[58] Field of Search ..... 223/85, 91, 93, 96, 223/88, 95; D6/319

[56] References Cited

U.S. PATENT DOCUMENTS

| | | | |
|---|---|---|---|
| 2,998,173 | 8/1961 | Lutz | 223/91 |
| 3,457,581 | 7/1969 | Oas | 223/91 X |
| 3,692,216 | 9/1972 | Becca | 223/91 |
| 3,897,893 | 8/1975 | Lemmenes | 223/91 |

FOREIGN PATENT DOCUMENTS

| | | | |
|---|---|---|---|
| 1424774 | 12/1965 | France | 223/91 |
| 2090182 | 7/1982 | United Kingdom | 223/85 |

*Primary Examiner*—Werner H. Schroeder
*Assistant Examiner*—Andrew M. Falik
*Attorney, Agent, or Firm*—Sughrue, Mion, Zinn, Macpeak and Seas

[57] ABSTRACT

A device for the presentation of textile products and the like comprises an upper bar (1) provided with a suspension hook (2) and a lower bar (7) suitable for holding an item to be presented. The bars are connected together at their two ends, leaving between them a passage for the item. The lower bar is an elastic arc with an upper side which is suitable for holding the item, and which is convex towards the lower side of the upper bar. The lower bar thus tends to press itself against the center of the lower side of the upper bar to lock the item between the two bars.

12 Claims, 2 Drawing Figures

A
A'
B
C
II
1
2
3
4
5
6
7
8
9
10
11
12
13
14
15
16
17
18
19
20
20'
21
21'
22
23
24
25
26

PRESENTATION DEVICE FOR TEXTILE PRODUCTS AND THE LIKE

DESCRIPTION

1. Field of the Invention:

The present invention relates to a presentation device for textile products and the like, and in particular, but not exclusively, to a presentation system for textile products and the like, such as covers for car seats, bath mats, plaids, and others such as garments, intended mainly for large stores and specialised retail shops.

2. Background of the Invention:

In this connection, the tendency has always been towards suspended presentation, in which an upper bar, fitted with a hook or other means of suspension, holds the item to be presented using various means, such as clips, hooks or other means, or using a bag fixed to the said bar, which bag contains the item. Alternatively, there may be provided another bar which carries the item, the other bag being connected to the upper suspension bar by its two ends.

These devices all have two notable disadvantages. Firstly, they need auxiliary means for fixing, which are costly in themselves and which complicate the positioning of the item, even deteriorating it because some of them pass through it. Secondly, they may not hold the item in a convenient position if, for example, a salesperson holds the carrying unit by one of its ends, which may cause the item to slide and form creases in it which are difficult to remove. Moreover, there exists the difficulty of correctly replacing the cover which normally envelops the item and its support.

Summary of the Invention

In accordance with the present invention, there is provided a device for the presentation of textile products and the like, comprising:

(a) an upper bar;

(b) a hook for hanging the upper bar on a clothes rack rod or the like;

(c) a lower bar suitable for holding an item to be presented and having ends connected to the respective ends of said upper bar and;

(d) a passage defined between the upper and lower bars.

The lower bar constitutes an elastic arc with an upper side suitable for holding the items; it is convex towards the lower side of the upper bar. The lower bar tends to push against the center of the lower side of the upper bar, in order to lock the item between the two bars.

According to a preferred embodiment of the invention, the upper bar and the lower bar have projections directed towards the internal space of the construction, which tend to prevent the item being displayed from sliding in relation to the bars which have the projections.

According to another preferred embodiment, the uprights attaching the upper bar to the lower bar are provided with spurs directed downwardly, which tend to hold in place a cover, which envelops in a known manner, the whole of the device, and the items which it carries.

Other constructive details of the device according to the invention will become apparent during the description given below, of an example of a variant of such a device, using the drawings appended to the present document.

Figures 1, 2:
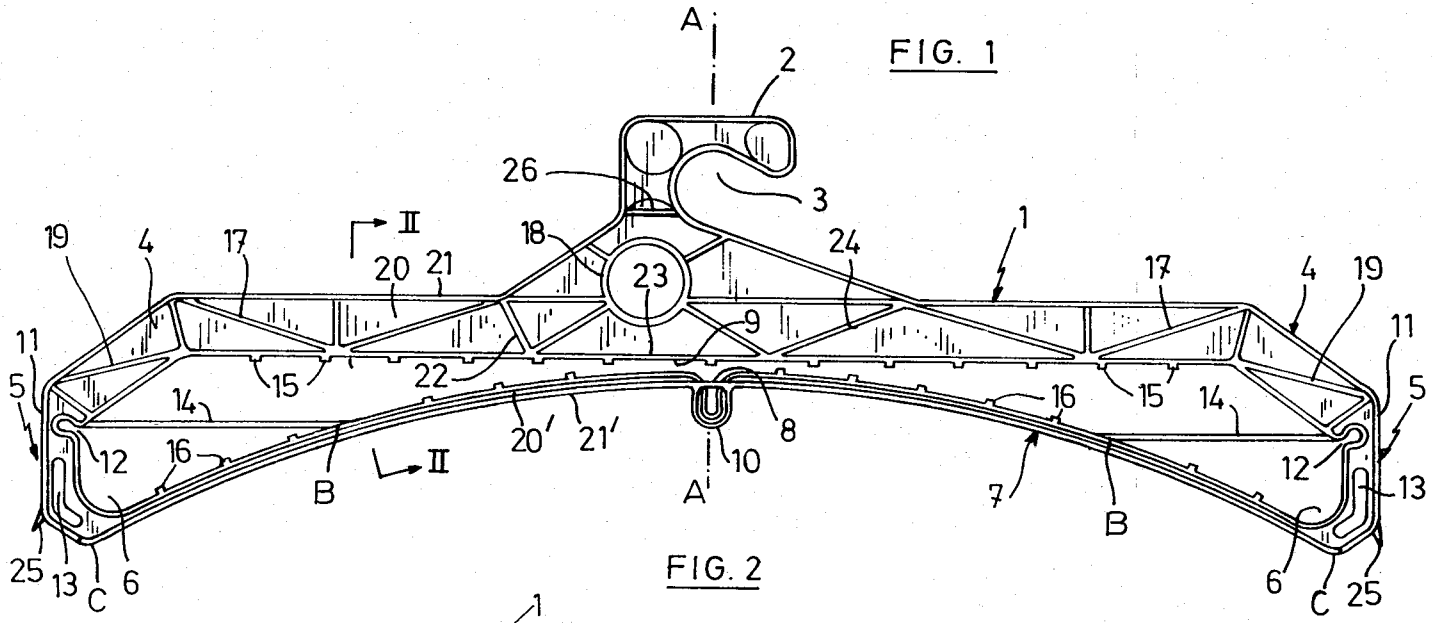
FIG. 1 is a side elevation of a device according to the invention.
FIG. 2 is a section of the device along the line II—II in FIG. 1, to a larger scale.

Detailed Description of One Embodiment of the Invention

A device according to the invention, is formed from a single piece which, in the example described, is obtained by injection of a synthetic plastics material such as polypropylene or polystyrene, the flexibility of which is used to obtain the mechanical effect sought. It consists of an upper bar 1, fitted with a suspension hook 2 on its upper part at approximately its middle, the exact position of this hook being defined by the condition that the center of a handle 3 used for hanging it up, falls along the vertical line AA of the center of gravity of the support according to the invention, and the item which it carries.

The upper bar 1 is rectilinear within the unit. It terminates at both its ends in portions 4 which are oblique to the longitudinal axis of the upper bar 1, which connect with uprights 5,5. At the bottom of these uprights, and connected to them by large connections 6,6 whose concavity is directed towards the upper bar 1, there is an elastic inward-curving bar 7, the convexity of which is directed towards the upper bar 1. The elasticity of the bar 7, the top of which 8, tends to push itself against the lower side 9 of the bar 1, allows it to be moved away from the bar 1, creating a passage between the two bars, through which an item to be displayed may be passed. In order to move the bar 7 away from the bar 1, the bar 7 is provided with a closed loop 10.

The uprights 5 are connected at their upper part, to the sloping parts 4 of the bar 1, by thinner parts 11,11 surrounding button hole shaped cutouts 12,12 which are open in the direction of the space defined between the bars 1 and 7. The uprights 5,5 are lightened by internal cutouts 13,13. The uprights have spurs 25 on the outside, directed downwards.

FIG. 2 shows a transverse section, the bar 1 having an H-shaped transverse section, and the bar 7 (and the uprights 5,5) having transverse sections which are substantially in the form of a T. The rigidity of the bar 7 is therefore less than that of the bar 1, and this allows the bar 7 to function in the manner of a spring. The uprights 20,20' of the H and T sections respectively, are inside the construction, while the transverse flanges 21,21' of the H-section and the T-section respectively, define the exterior of the construction. The shape chosen for the sections imparts a high moment of inertia to all parts of the support, while allowing them to be very light.

The hook 2 itself, has a transverse section in the form of an H. Below the hook, flanges on both sides of the hook are joined by a raised section 26. These arrangements act against torsions which may be exerted on the hook when placing it on a suspension bar, or when lifting it alone.

The central core of the rectilinear part of the bar 1, and the sloping parts 4,4' have raised sections such as 17, 18, 19, 22, 23, 24, and the like, which also contribute in conferring stiffness to all these parts. In this way, the character of a rigid beam is given to the bar 1 and the sloping parts 4,4'.

Ties 14,14, connect the points B of the upper side of the curved bar 7 to the base of the sloping sections 4,4 of the bar 1. These ties, which start at the upper part of the open buttonholes 12, and the points of attachment B of the ties 14,14 to the bar 7, are at a distance from the top of the arc which is equal to about $\frac{2}{3}$ of the half-length of the arc of the bar 7.

The surfaces on bars 1 and 7 which are turned towards the internal space between the bars, are provided with projections, such as 15,15 and 16,16, and those on one bar fit in between those on the opposite bar. The role of the projections is to give those surfaces on the sides of the bars 1 and 7, which are turned to face each other, a certain roughness which prevents an item from sliding along these sides.

In order to use the illustrated device according to the invention, the lower bar 7 and the upper bar 1 are separated by pulling the loop 10. In this way a passage is formed between the bars 1 and 7, into which the item to be displayed may be slid. Holding the support by its hook 2, the item being displayed (not shown) tends to separate the two bars and to give to the ties 14,14 and that part of the bar 7 which is between them, a horizontal direction. Therefore, there is no tendency to form a crease in the suspended item. This situation, in which the uprights 5,5 are slightly separated outwards, is not significantly modified if, when the support is suspended by its hook 2, a salesperson goes to seize the support by one of its ends in order to free the hook 2, and also allows a row of items suspended on similar devices, to be drawn back. In this case, the upright 5 of the side seized tends to approach the axis AA and that part of the lower curved bar which starts at this upright, tends to approach the lower side of the bar 1. The projections carried by the two bars tend to approach each other because of this, and to prevent the item sliding towards the upright which has been seized. Creasing faults cannot therefore form in the displayed item. On the other hand, the spur situated at the base of the upright opposite that which has been seized, tends to retain the normal protective cover surrounding the whole, so that this cover also retains its normal position. The replacement of a suspended item correctly, surrounded by its still intact cover, into a row of hooked devices placed side-by-side, can be made without any tedious or difficult manipulation, and this is of great benefit, particularly for shops which have large areas or where similar items are displayed within reach of clients who are usually crowded and who often pay little attention to the condition of items which they have decided not to purchase.

We claim:

1. A device for the presentation of textile products and the like, comprising:

(a) an upper bar (1);

(b) means (2) for suspension on said upper bar;

(c) a lower bar (7) for holding an item to be presented and whose ends are connected to the respective ends of said upper bar; and (d) a passage defined between said upper and lower bars, the lower bar comprising an elastic arc with an upper side (8) suitable for holding said item and convex towards a lower side (9) of said upper bar, said lower bar tending to push against a center of said lower side of said upper bar to lock said item between the two bars, wherein said lower bar is connected at its ends to the ends of said upper bar by substantially vertical uprights (5), said uprights having button hole shaped cutouts (12) open towards said passage at points of attachment of said uprights to said upper bar.

2. A device as claimed in claim 1, wherein the ends of said lower bar are attached to lower ends of said vertical uprights by connections (6) which have arcs of curvature opposite to that of said lower bar.

3. A device as claimed in claim 1, wherein said lower bar has a closed finger loop near a top of said arc for separating said lower bar from said upper bar to enlarge the passage between the two bars for the insertion of said item.

4. A device as claimed in claim 1, wherein said upper and lower bars have projections (15, 16) directed towards said passage to prevent said item being presented from sliding in relation to said bars.

5. A device as claimed in claim 1, wherein the uprights have external spurs (25) directed downwardly adapted to hold in place a protective cover enclosing the presentation device and said item.

6. A device as claimed in claim 1, made of a single piece of synthetic plastics material.

7. A device as claimed in claim 6, wherein said plastics material comprises polypropylene.

8. A device as claimed in claim 6, wherein said plastics material comprises polystyrene.

9. A device for the presentation of textile products and the like, comprising:

(a) an upper bar (1);

(b) means (2) for suspension on said upper bar;

(c) a lower bar (7) for holding an item to be presented and whose ends are connected to the respective ends of said upper bar;

(d) a passage defined between said upper and lower bars, the lower bar comprising an elastic arc with an upper side (8) suitable for holding said item and convex towards a lower side (9) of said upper bar, said lower bar tending to push against a center of said lower side of said upper bar to lock said item between the two bars; and (e) two ties (14) individually connecting first points (B) on said lower bar spaced inwardly from the ends thereof to second points on vertical uprights individually connecting the ends of the upper and lower bars together, said second points being situated above button hole shaped cutouts in the uprights.

10. A device as claimed in claim 9, wherein each first point is situated at a distance from a top of said arc formed by said lower bar, equal to about $\frac{2}{3}$ of the half-length of said arc.

11. A device for the presentation of textile products and the like, comprising:

(a) an upper bar (1);

(b) means (2) for suspension on said upper bar;

(c) a lower bar (7) for holding an item to be presented and whose ends are connected to the respective ends of said upper bar; and (d) a passage defined between said upper and lower bars, the lower bar comprising an elastic arc with an upper side (8) suitable for holding said item and convex towards a lower side (9) of said upper bar, said lower bar tending to push against a center of said lower side of said upper bar to lock said item between the two bars, wherein a transverse section of said upper bar and sloping extensions (4) thereof is substantially in the shape of an H, and a transverse section of said lower bar and uprights (5) which connect said lower bar to said upper bar is substantially in the shape of a T, the presentation device being limited externally by flanges (21) of said sections.

12. A device as claimed in claim 11, wherein the transverse section of the means for suspension is in the shape of an H.

* * * * *